US006855175B2

(12) United States Patent
Boliek

(10) Patent No.: US 6,855,175 B2
(45) Date of Patent: Feb. 15, 2005

(54) HEAT-SETTING METHOD

(75) Inventor: John E. Boliek, Hockessin, DE (US)

(73) Assignee: Invista North America Sarl., Wilmington, DE (US)

( * ) Notice: Subject to any disclaimer, the term of this patent is extended or adjusted under 35 U.S.C. 154(b) by 16 days.

(21) Appl. No.: 10/290,576

(22) Filed: Nov. 8, 2002

(65) Prior Publication Data

US 2003/0088924 A1 May 15, 2003

(30) Foreign Application Priority Data

Nov. 13, 2001 (JP) ..... 2001-347892

(51) Int. Cl.[7] ..... D06P 5/02; D06P 7/00
(52) U.S. Cl. ..... 8/491; 8/922; 8/933
(58) Field of Search ..... 8/491, 922, 933, 8/929

(56) References Cited

U.S. PATENT DOCUMENTS

| | | | |
|---|---|---|---|
| 4,906,729 | A | 3/1990 | Greene et al. |
| 4,937,314 | A | 6/1990 | Greene |

FOREIGN PATENT DOCUMENTS

| | | | |
|---|---|---|---|
| JP | 0734364 | A | 2/1995 |
| JP | 0 7-252777 | * | 3/1995 |
| JP | 0725277 | A | 10/1995 |

* cited by examiner

*Primary Examiner*—Margaret Einsmann
(74) *Attorney, Agent, or Firm*—Robert R. Furr, Jr.

(57) ABSTRACT

The invention provides a method of treating fabrics containing polyetherester fibers so that the fabrics retain their basis weight, power, and stretch without edge curl. Fabrics containing polyetherester fibers are heat-set after dyeing, preferably in a temperature range of 160–180° C. (dry) or 115–140° C. (steam).

5 Claims, No Drawings

HEAT-SETTING METHOD

This application claims priority from Japanese Patent Application 347892/01, filed Nov. 13, 2001.

BACKGROUND OF THE INVENTION

1. Field of the Invention

The present invention relates to a method of treating fabrics containing polyetherester fibers, in particular, to heat-setting such fabrics after dyeing, so that they retain high basis weight, power, and stretch without edge curl.

2. Description of Background Art

Apparel fabrics containing elastomeric fibers such as spandex and polyetherester fibers have gained popularity as comfort and ease-of-movement have become more important to the consumer. During their manufacture, such fabrics are generally subjected to thermal treatment, for example to prevent edge curling, and they are also often dyed. Polyetherester fibers have been described, for example in U.S. Pat. Nos. 4,906,729 and 4,937,314, which patents are incorporated by refernce as if set forth in length herein. Various methods of heat-setting and dyeing fabrics containing polyetherester elastomeric fibers have been described, for example in Japanese Published Patent Applications JP07-34364 and JP07-252777, but the processes described require extra steps and more energy and therefore are less economical than desired.

Heretofore, fabrics containing polyetherester fibers have been processed through many steps in order to try to stabilize them, and persistent problems have arisen such as having to accept one deficiency in order to remove another. Such trade-offs have involved edge curling, fabric width, basis weight, power, and stretch. The inventor conducted extensive studies to understand the effect of the order of process steps, temperatures, times, etc. of stabilizing fabrics containing polyetherester fibers, examining a wide variety of variables to find the optimum conditions and method for treating such fabrics. Accordingly, it is an object of the invention to prevent edge curling in fabrics containing polyetherester fibers without creating other problems such as loss of fabric basis weight, power, stretch, and width.

The invention provides a method of treating stretch fabrics containing elastomeric polyetherester fibers, comprising the sequential steps of preparing the fabric without heat-selling, dyeing the fabric, and heat-setting the fabric. The heat-setting can be carried out dry at 160–180° C. for a period of 10–60 seconds or wet (steam) at 115–140° C. for a period of 10–60 seconds. The process can also include a mild pre-heat-setting step at less than 150 DC before dyeing, to assist with the handling of fabrics that are particularly prone to curl and shrink, but this is not usually necessary.

The polyetherester fibers can be made from a polyether glycol, a low molecular weight diol, and a dicarboxylic acid or dialkyl ester of a dicarboxylic acid. Useful examples of polyether glycols include poly(ethyleneether) glycol, poly (propyleneether) glycol, poly(tetramethyleneether) glycol, copolymers thereof, and poly(tetramethyleneether-co-2-methyltetramethyleneether) glycol. The number-average molecular weight of the polyether glycol can be in the range of 1000 to 5000. When poly(tetramethyleneether-co-2-methyltetramethylene-ether) glycol is used, the 2-methyltetramethyleneether moieties can make up 3 to 20 mole percent of the total polyether.

The low molecular weight diol used to make the polyetherester can be ethylene glycol, trimethylene diol, 1,4-butanediol, and mixtures thereof. The diacid can be terephthalic acid (which is preferred), isophthalic acid, 2,6-naphthalenedicarboxylic acid, and the like. An example of a useful dialkyl ester is dimethyl terephthalate. A catalyst such as tetrabutyl titanate can be used to accelerate the polymerization reaction.

The "soft segment" is primarily polyether, and the 'hard segment' is polyester formed from the low molecular weight diol and the diacid. The molar ratio of hard segment to soft segment can be 2–5.

Such polyetheresters can be melt-spun or dry-spun. When their melting points are sufficiently low to minimize thermal degradation during spinning, melt spinning is preferred. A variety of stabilizers can be used to reduce the damaging effect of UV light and environmental oxidizing agents, and pigments and delustrants such as titanium dioxide can also be added.

The fabrics treated by the process of the present invention can be woven (for example plain, twill, or satin) or knit (for example warp knit or weft knit). Useful knits include tricot, single, double, and flat-bed knits.

The amount of polyetherester fiber in the fabric can be in a range of 2–60 wt % o. If less polyetherester fiber is used, the fabric stretch is too low, and if more is used, fabric stretch and/or basis weight may become too high.

The other (non-elastomeric) fibers in the fabric can be poly(ethylene terephthalate), poly(hexamethylene adipamide), polycaproamide, copolymers thereof, and the like. In the case of warp knits and wovens, the non-elastomeric fibers can be knit or woven with the polyetherester fiber in the warp direction, the weft direction, or both. The polyetherester can be bare (uncovered) or covered with a non-elastomeric fiber.

The fabric can be unrestrained (relaxed) or under tension during heat-setting. In order to maintain the width of the finished fabric, some tension during heat-setting is preferred.

Fiber and fabric tensile measurements were made using an Instron tensile tester. "First cycle" refers to fiber tensile measurements taken on a first stretch. "Fifth cycle" refers to fiber tensile measurements taken on the fifth cycle of repeated 0–200–0% stretch-and-relax cycles. Fiber "load" and "unload" powers refer to the stress on the fiber at 50% stretch on the fifth stretch and fifth relaxation, respectively, of repeated 0–200–0% stretch-and-relax cycles. Fifth-cycle set was measured by comparing the length of the fiber before the fifth stretch with that after the fifth relaxation of repeated 0–200–0% stretch-and-relax cycles.

Fabric samples were prepared by cutting 7.6 cm×20.3 cm rectangles of fabric, folding the rectangles, and sewing them to form 7.6 cm×7.6 cm loops with 2.5 cm flaps expending beyond the point of sewing; the flaps were held in the grips of the tensile tester. Fabric warp load and unload powers were the stresses on the fiber measured on a third stretch and third relaxation, respectively, of repeated 0–80–0% stretch-and-relax cycles; fabric powers were measured in the warp direction and are reported in grams. The warp stretch was the percent stretch created by applying a 5.4 Kg force to the fabric on the third stretch of repeated 0–80–0% stretch-and-relax cycles.

The fibers used in the invention were prepared as follows. Poly(tetramethylene-co-2-methyltetramethyleneether) glycol prepared by ring-opening copolymerization of tetrahydrofuran and 3-methyltetrahydrofuran (2700 molecular weight; 8 mole 2-methyltetramethylene moiety; 71.2 wt %), 1,4-butanediol (9.9 wt %), and dimethyl terephthalate (18.3 wt %) were reacted at elevated temperature and reduced pressure to form a segmented polyetherester having 25 wt % hard segment (poly(butylene terephthalate)) and a hard segment/soft segment mole ratio of 4.6. An antioxidant (0.5 wt %; Ethanoxo®330 [2,4,6-tris(3,5-di-t-butyl-4-hydroxybenzyl)mesitylene]; Albemarle Chemical) was mixed into the molten polymer. The polymer was melt-spun at 235° C. and 550 meters/min to form 44 decitex monofilament fibers which were not drawn. The fibers had first-cycle tenacity-at-break of 0.9 deciNewtons per (unstretched) tex, first-cycle elongation-at-break of 527%, and fifth-cycle set of 21%. After 30 minutes boil-off at 50% stretch, each fiber showed fifth-cycle load and unload powers at 50% stretch of 0.8 and 0.5 grams, respectively.

The fabric used in the invention was prepared as follows. Fifty-six beams (each 0.6 meters wide and containing 915 meters of 28 ends at 74% stretch on beam) were prepared from fibers made as described above. Warp knits were prepared on a 32 gauge tricot machine with 44 decitex/13 filament Antron® T-865 nylon (a registered trademark of E. I. du Pont de Nemours and Company) companion fibers. On each of the first and second knitting machine shafts were mounted 28 beams of the polyetherester fiber, and on the third shaft were mounted two beams of the nylon fiber. The knitting machine speed was 550 meters/min. The polyetherester knitting tension was 21 grams/3 ends, the polyetherester runner length was 66 cm, the nylon runner length was 147 cm, and the wale and course counts were 178 ends/cm and 241 ends/cm, respectively. The greige fabric had 20 wt % polyetherester fiber content and was 110 cm wide.

EXAMPLE 1

The greige fabric prepared as described above was scoured in one pass through an open-width washer (Jawetex A.G. Textilmachinen) at 71° C. with 1.5 g/liter Dupanol®EP (nonionic surfactant) and 1.5 g/liter trisodium phosphate. The scoured fabric was dried on a tenter frame at 121° C. and then jet-dyed in a low profile horizontal dyeing machine (Hisaka Works, Ltd.) with a mixture of Supernylite Scarlet B and Nylanthrene Red B dyes at pH 5–6 and 100° C. for 90 minutes, cooled, and finally rinsed for 30 minutes at 82° C. The dyed fabric was heat-set at 171° C. for 30 seconds with 10% machine-direction overfeed on an 81 cm wide tenter frame (providing moderate cross-direction tension) and then dried at the same width on the tenter frame at 121° C. Fabric properties are given in Table I.

COMPARISON EXAMPLE 1

The greige fabric prepared as described above was treated as described in Working Example 1, but the heat-setting step was carried out before dyeing. Fabric properties are reported in Table I.

COMPARISON EXAMPLE 2

The greige fabric made above was processed as in Comparison Example 1, but the heat-setting was carried out at 149° C.

TABLE 1

| Sample | Width (cm) | Weight (g/cm$^2$) | Load Power (g) | Unload Power (g) | Warp Stretch (%) | Edge Curl |
|---|---|---|---|---|---|---|
| Greige fabric (after boil-off) | 64 | 257 | 1175 | 775 | 192 | Yes |
| Working Example 1 | 75 | 192 | 707 | 506 | 230 | No |
| Comparison Example 1 | 77 | 70 | 490 | 308 | 162 | No |
| Comparison Example 2 | 64 | 204 | 925 | 600 | 182 | Some |

Table I shows that heat-setting fabrics containing polyetherester fibers after dyeing (according to the invention) is sufficient to prevent edge curl and that a fabric so treated retains high power and stretch without losing basis weight. In contrast, the first Comparison fabric, heat-set before dyeing (not of the invention) has reduced basis weight, power, and stretch. Attempts to prevent loss of fabric weight in fabrics which were heat-set before dyeing by reducing the heat-setting temperature as in Comparison Example 2 resulted in unacceptable loss of fabric width, and edge curl began to be observed.

The fabrics treated by the method of the present invention have high load and unload powers, high stretch, no significant edge curl, and good basis weight. The process eliminates a step of heat-setting before dyeing. Such fabrics are very suitable for use in apparel.

What is claimed is:

1. A method of treating fabric comprising the sequential steps of:

(a) preparing a fabric comprising polyetherester fiber wherein said polyetherester fiber is prepared from poly(tetramethylene-co-2-methyltetramethyleneether) glycol; 1,4-butanediol, and dimethyl terephthalate;

(b) dyeing said polyetherester fabric; and (c) heat-setting said dyed polyetherester fabric;

wherein said fabric is dry heat-set at 171–180° C. for 10–60 seconds.

2. The method of claim 1 further comprising a step of preheat-setting said fabric comprising polyetherester fiber at less than 150° C. after step (a) and before step (b).

3. A fabric comprising polyetherester fiber prepared according to claim 1.

4. A fabric comprising polyetherester fiber prepared according to claim 2.

5. The method of claim 1 wherein said fabric comprises 2–60 wt % polyetherester fiber.

* * * * *